US006786747B1

(12) United States Patent
Kamath

(10) Patent No.: US 6,786,747 B1
(45) Date of Patent: Sep. 7, 2004

(54) AXIAL ADJUSTABLE CONNECTOR SHORTING ASSEMBLY

(75) Inventor: Shashidhar M. Kamath, Canton, MI (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 10/238,679

(22) Filed: Sep. 11, 2002

(51) Int. Cl.[7] ..... H01R 29/00
(52) U.S. Cl. ..... 439/188
(58) Field of Search ..... 439/188, 352, 439/752

(56) References Cited

U.S. PATENT DOCUMENTS 4,582,376 A 4/1986 Olsson
5,370,543 A * 12/1994 Hamada et al. ..... 439/188
5,693,924 A 12/1997 Fetterolf, Sr. et al.
5,944,547 A 8/1999 Golab et al.
6,241,542 B1 6/2001 Nishide et al.
6,494,733 B2 * 12/2002 Saka et al. ..... 439/352
6,530,800 B2 * 3/2003 Nakamura ..... 439/352
6,551,146 B2 * 4/2003 Nakamura ..... 439/752
6,602,086 B2 * 8/2003 Tsuji et al. ..... 439/352

* cited by examiner

*Primary Examiner*—Tulsidas C. Patel
(74) *Attorney, Agent, or Firm*—Daniel R. Edelbrock

(57) ABSTRACT

A connector assembly has mating first and second electrical connectors and a holder in which the mated connectors are adjustable in an axial direction. The holder secures the first connector in a first position wherein electrical terminals within the first connector are engaged with shorting contacts in the holder. The first connector is held in this position while the second connector is pushed into the holder and mated with the first connector, causing terminals within the second connector to be brought into electrical connection with the terminals in the first connector and releasing the first connector from the holder securement. Further pushing of the second connector into the holder locks the connectors together and moves the mated connectors as a unit to a second position within the holder. Simultaneously, parts of the first connector force the shorting contacts out of electrical connection with the terminals. These parts exert a wiping action on the shorting contacts. When the connectors need to be separated the first and second connectors are moved as a unit back to the first position. The shorting contacts are reengaged with the terminals in the first connector before the connectors are electrically disconnected.

18 Claims, 8 Drawing Sheets

AXIAL ADJUSTABLE CONNECTOR SHORTING ASSEMBLY

BACKGROUND OF THE INVENTION

1. Field of the Invention

The invention relates generally to electrical connectors and more specifically to mating connectors that include shorting bars to protect the circuits.

2. Discussion of Related Art

Shorting bar systems have been employed on vehicle safety devices such as airbags, seat restraints and ABS brakes. For example, in airbag connectors, the shorting bars short circuit the triggering circuit by shorting the female terminals in the female connector to each other if the connectors are inadvertently disconnected or intentionally disconnected for maintenance or testing purposes. Since these are generally low current components, there can be a buildup of oxidation on the electrical contacts, causing electrical discontinuity in the circuits. Often, in the assembly process, the electrical connections in these safety devices are made by hand because of the fragility of the components and the relative complexity of the assembly process. With the continued automation of automotive assembly lines, modular assembly of these devices has become necessary.

Typically, a mating electrical connector disconnects the short. A female connector housing has female terminals and shorting bars. The shorting bars are shaped and spring biased to be in electrical engagement with the female contacts. A male connector housing has male contacts and engagement posts. When the connector housings are mated, the male contacts are mechanically and electrically connected to the female contacts. The engagement posts of the male connector housing disengage the shorting bars from the female contacts, eliminating the short circuit and making the connector assembly fully operational.

In many cases, oxidation can occur on the shorting bar contact surfaces, affecting the reliability of the short connection with the terminals. The engagement posts are often thin and short, and inaccuracies in length and position caused by the molding process may cause them to miss or ineffectively deflect the shorting bars. In addition, there is typically nothing to protect the mated connectors in vehicle areas such as engine compartments. If they are jostled or collide with other vehicle components, the male and female connectors can shift or vibrate relative to each other. This can damage the terminals and cause them to wear on each other. Fretting corrosion, which occurs when parts of the terminal plating flake off and oxidizing takes place on the exposed terminal surfaces, is not uncommon. However, if the electrical connection process becomes more complex when these problems are addressed, there is a risk that assembly can no longer be automated.

SUMMARY OF THE INVENTION

Accordingly, it is an object of this invention to ensure positive contact between male and female terminals in mating connectors prior to disconnect of a safety short, and to ensure the safety short is reconnected before the terminals are unmated.

A further object of the invention is to enable the connector assembly to be axially adjustable as a unit so connectors of the assembly do not move relative to each other.

Another object of the invention is to provide a simple, reliable shorting system for a fully automated modular connector assembly.

In carrying out this invention in the illustrative embodiment thereof, a holder is used to secure a female connector in a first position. The holder has shorting contacts. The female connector has slots through which the shorting contacts engage female terminals within the female connector in the first position. There are cam surfaces at ends of the slots. When a male connector is inserted into the holder, the female connector remains in the first position until the connectors are fully mated with male terminals in the male connector in electrical engagement with the female terminals. Further insertion of the male connector releases the female connector from the first position and locks the connectors together. The connectors move together as a unit to a second position. Simultaneously, the cam surfaces push the shorting contacts out of the slots, enabling functional operation of the connectors. Any forces pushing or pulling on the connectors cause them to move as a unit in an axial adjustable direction within the holder, preventing damage to and reducing wear on the terminals and allowing for manufacturing tolerances, until the connectors are secured in a required position by, for example, locking tabs on the male connector.

When it is desired to break the electrical connection and separate the connectors, the connectors are pulled or pushed back to the first position within the holder. The female connector again becomes locked in the first position by the holder as the shorting contacts reengage the female terminals. Further removal force on the male connector then separates the connectors and takes the male connector out of the holder. Operation of the shorting contacts and holder and connector locks is achieved simply by movement of the connectors axially within the holder, so the assembly and disassembly of the connectors can be fully automated.

BRIEF DESCRIPTION OF THE DRAWINGS

This invention, together with other objects, features, aspects and advantages thereof, will be more clearly understood from the following description, considered in conjunction with the accompanying drawings.

DETAILED DESCRIPTION OF THE PREFERRED EMBODIMENT

Figure 1:
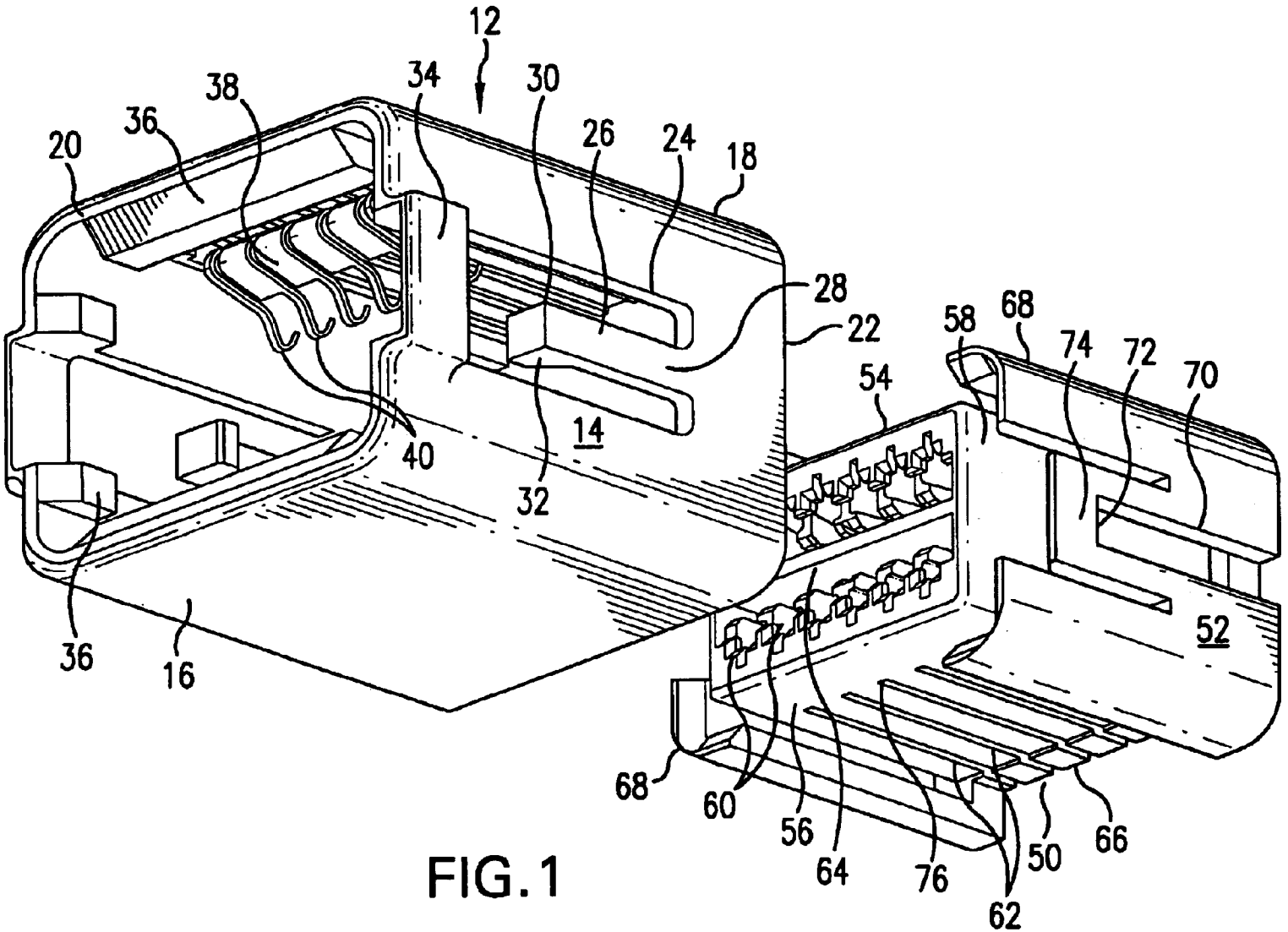
FIG. 1 is a perspective view of a holder and female connector prior to assembly.

Referring now to FIG. 1, the female half of the connector assembly of the present invention is illustrated. The female half of the connector assembly could be snapped into a vehicle panel using conventional panel locks or could be used simply as an in-line connection. A holder 12 comprises side walls 14, a bottom wall 16, a top wall 18, an open first end 20 and an open second end 22. The side walls 16 each include a substantially rectangular aperture 24 in which a lock arm 26 is formed. The lock arm 26 has a first end 28 integral with the side wall and extending from adjacent the holder second end 22. The lock arm 26 has a second, free end 30 with a pawl 32 projecting into an interior of the holder. Since the apertures are relatively large, braces 34 extend across the apertures and provide stability to the side walls. The braces jut away from the side walls because of tooling requirements in molding the lock arms. Stop blocks 36 protrude from the top, bottom and side walls part way into the interior of the holder adjacent the first end 20.

The top and bottom walls of the holder each have a shorting bar 38 extending across the walls from side wall to side wall. The shorting bars 38 each have a plurality of flexible contacts 40 curved and spring-biased to extend into the interior of the holder in the direction of the holder second end 22.

A female connector 50 has an electrically insulative housing comprising two side walls 52, upper wall 54 and lower wall 56. The housing has an interior body 58 including a plurality of terminal accommodating chambers 60 for receiving female electrical terminals. Narrow slots 62 in the upper and lower walls communicate with the chambers 60. The connector 50 has an insertion end 64 for insertion into the holder 12 and an opposite female terminal receiving end 66. Projecting from the side walls over portions of the upper and lower walls are guide rails 68. The side walls further include channels 70 extending from the female terminal receiving end 66 and ending at chamfered latch edges 72 on cross-pieces 74. The cross-pieces 74 are cantilevered on the side walls so they can flex relative to the interior body 58.

Figure 2:
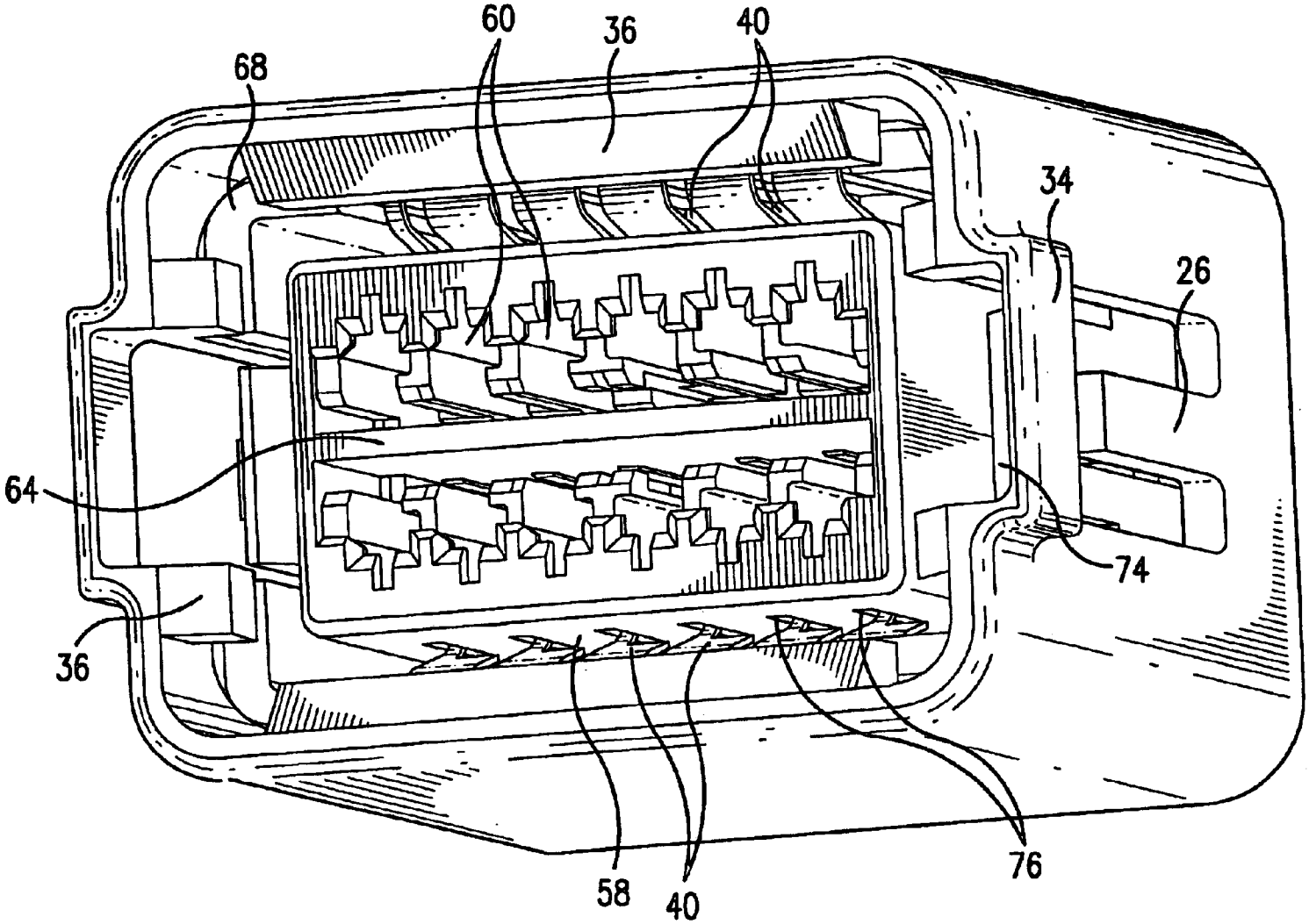
FIG. 2 is a perspective view of the assembled holder and female connector.

The insertion end 64 of the female connector 50 is pushed into the holder 12 through the second end 22 of the holder. The guide rails 68 of the connector housing are guided by inside surfaces of the holder walls to provide smooth, correct assembly. The shorting contacts 40 are deflected toward the holder upper and lower walls by the connector body 58. The lock arms 26 of the holder follow the channels 70 of the female connector 50 until the pawls 32 are lifted by the crosspieces 74 and then drop into the channel. The slots 62 have beveled termination or cam surfaces 76 at their ends or extremities spaced inward along the body 58 a short distance from the insertion end 64 of the female connector. The distance is set such that the shorting contacts 40 drop into the slots 62 just prior to when the ends of the guide rails 68 of the connector abut against the stop blocks 36 of the holder. The assembled holder 12 and female connector 50 are shown in FIG. 2. In the assembled condition, the contacts 40 of the shorting bars 38 extend through the slots 62 of the female connector into the terminal accommodating chambers 60. If an attempt is made to remove the female connector from the holder, the pawls 32 press against the latch edges 72. Further insertion movement of the female connector is prevented by the force of the holder stop blocks 36 against ends of the guide rails 68 of the connector. Therefore, the female connector 50 is held in a first, short-active position within the holder 12. It can only be removed by manually lifting the pawls 32 out of the channels 70 and sliding the connector in a reverse direction.

Figure 3:
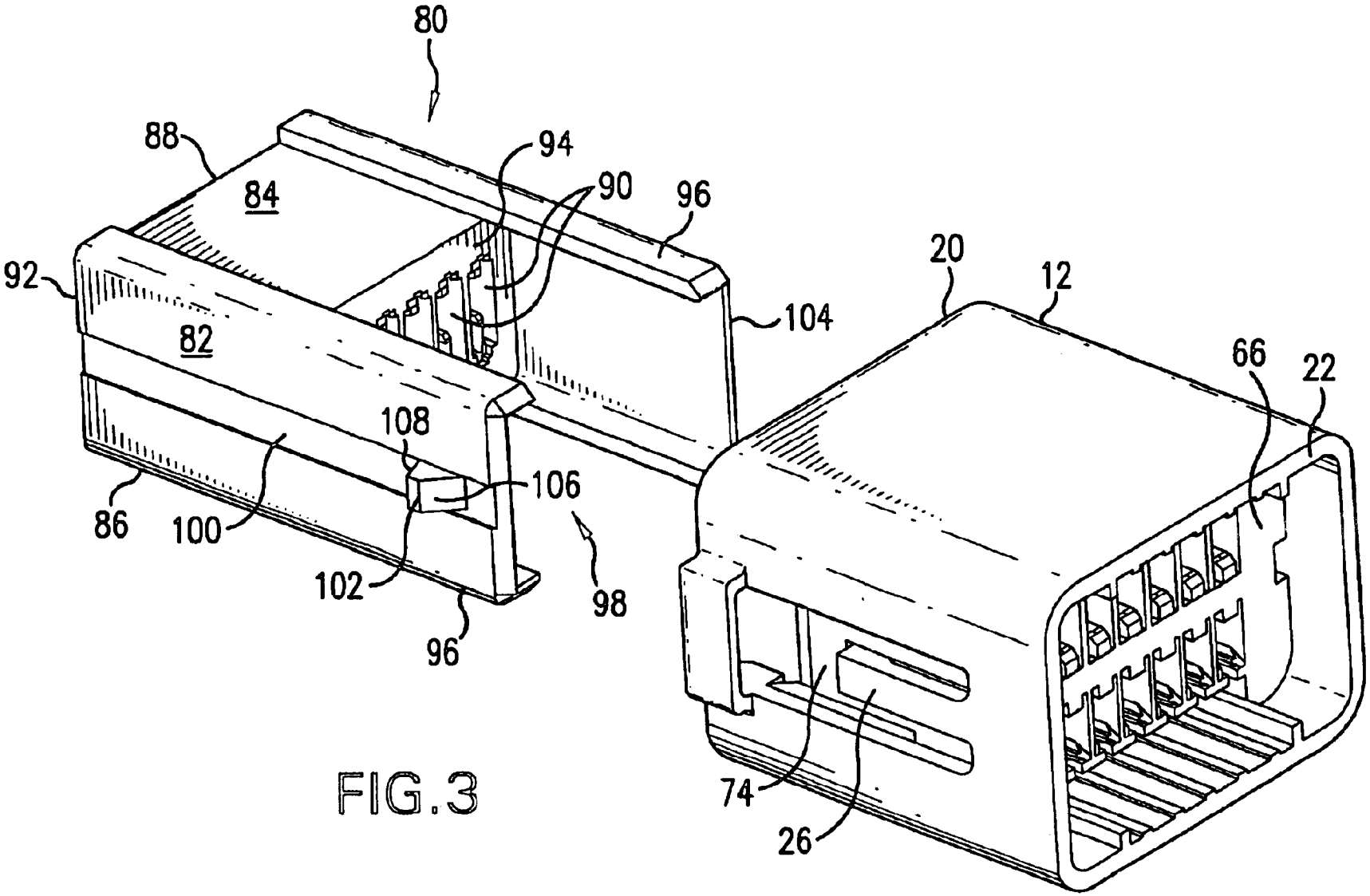
FIG. 3 is a perspective view of the assembled holder and female connector and a male connector positioned for engagement with the assembly.

FIG. 3 shows the assembled holder and female connector from the perspective of the holder end 22, as well as a male connector 80 positioned for mating with the female connector 50. The male connector comprises an electrically insulative housing having side walls 82, an upper wall 84 and a lower wall 86. A main body 88 of the housing includes terminal accommodating chambers 90 for receiving male electrical terminals through a male terminal receiving end 92. The body terminates approximately half-way along the side walls 82 at an opposite mating surface 94. Formed on the side walls 82 are guide wings 96, giving each side wall a u-shaped extension defining an open interior space 98 of the housing beyond the body 88. On an outer surface of each side wall and wing is a continuous groove 100 with a ramp projection 102 protruding from the groove and outer surface of the wing adjacent an insertion end 104 of the male connector 80. The ramp projections have opposite forward and rearward angled operating surfaces 106 and 108, respectively, with the rearward operating surface 108 having a slightly steeper angle.

The holder and connector housings may be molded from an electrically insulative plastic, for example polybutylene terapthalate. The shorting bars may be stamped and bent from an electrically conductive metal, insert-molded or press-fitted into the holder. The male and female connectors are used only for illustration purposes. For example, the holder may be used to first receive a male connector to hold in the first position for later mating with a female connector. The words top, bottom, upper, lower and side are used only to describe the invention as illustrated by the drawings. The holder and connectors may be in any spatial orientation.

As the insertion end 104 of the male connector 80 is pushed in through the open first end 20 of the holder 12, the guide wings 96 of the male connector slide under the side walls 52 of the female connector 50. The forward operating surfaces 106 of the ramp projections 102 on the guide wings lift the cross-pieces 74 of the female connector side walls. Further insertion movement causes the ramp projections 102 to lift the pawls 32 on the ends 30 of the holder lock arms 26. The cross-pieces 74 then drop back down behind the rearward operating surfaces 108 of the ramp projections, securing the male and female connectors in a fully mated condition. However, pawls 32 of the holder lock arms 26, having been pushed away from the latch edges 72, no longer hold the female connector in the first position. At this short-active first position the male and female connectors are engaged and the male and female terminals within the male and female connectors, respectively, are electrically mated. Further pushing of the male connector causes the two connectors to axially move within the holder toward the end 22 of the holder to a second position wherein the shorting contacts 40 of the holder are disconnected from the female terminals within the female connector.

Figure 4:
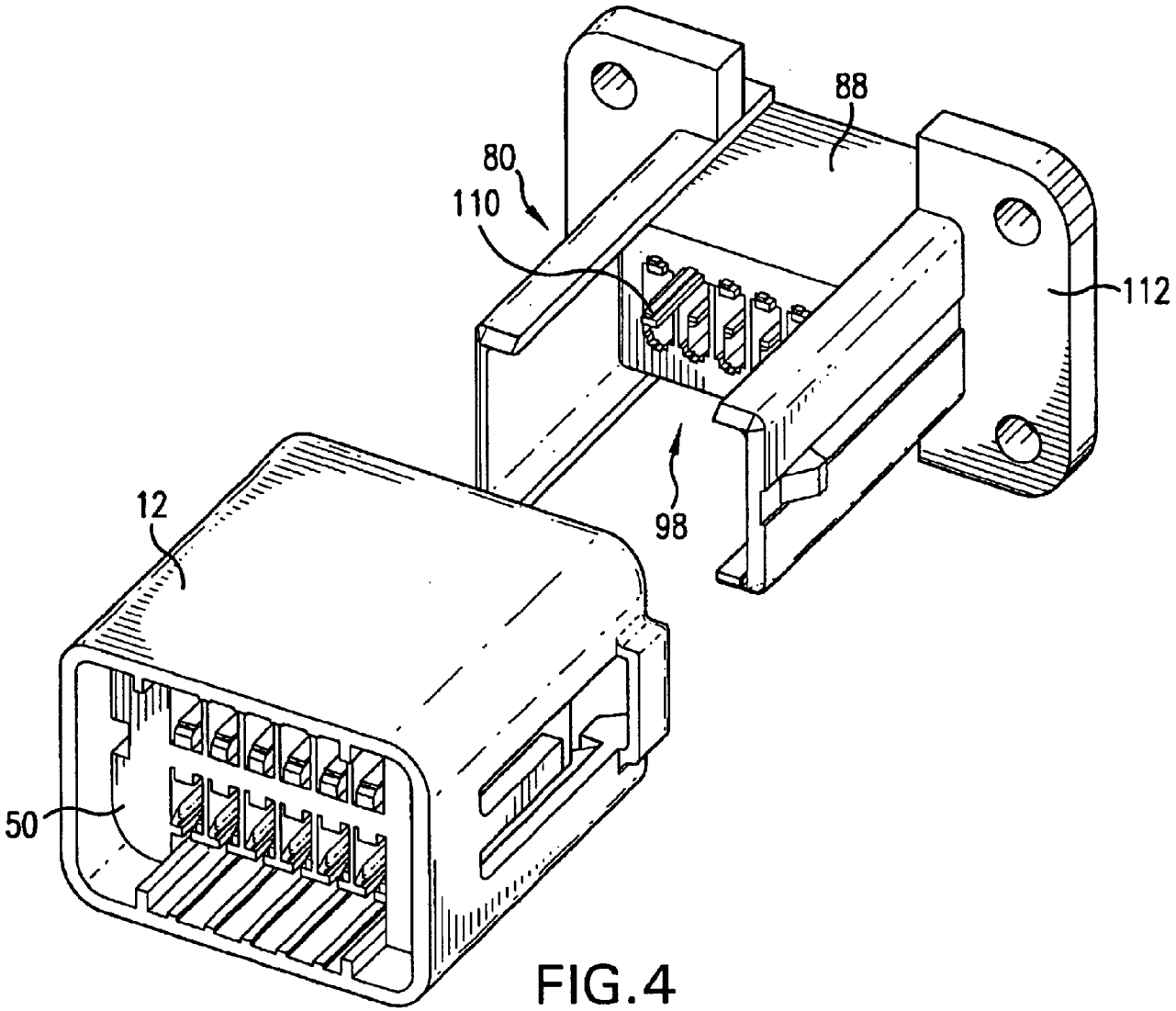
FIG. 4 is a perspective view of the assembled holder and female connector and a male connector with a male terminal positioned for electrical engagement.

FIG. 4 illustrates the assembled holder and female connector from a different perspective, along with the male connector. This figure includes a representation of a male terminal 110, demonstrating how it extends from the body 88 of the male connector 80 into the interior space 98 for eventual insertion into a terminal accommodating chamber 60 of the female connector 50. Also illustrated in FIG. 4 is an example of an optional bracket 112 on the male connector for possible attachment to a vehicle body panel after the connectors have been mated and moved to the second, short-disconnected position.

Figure 5:
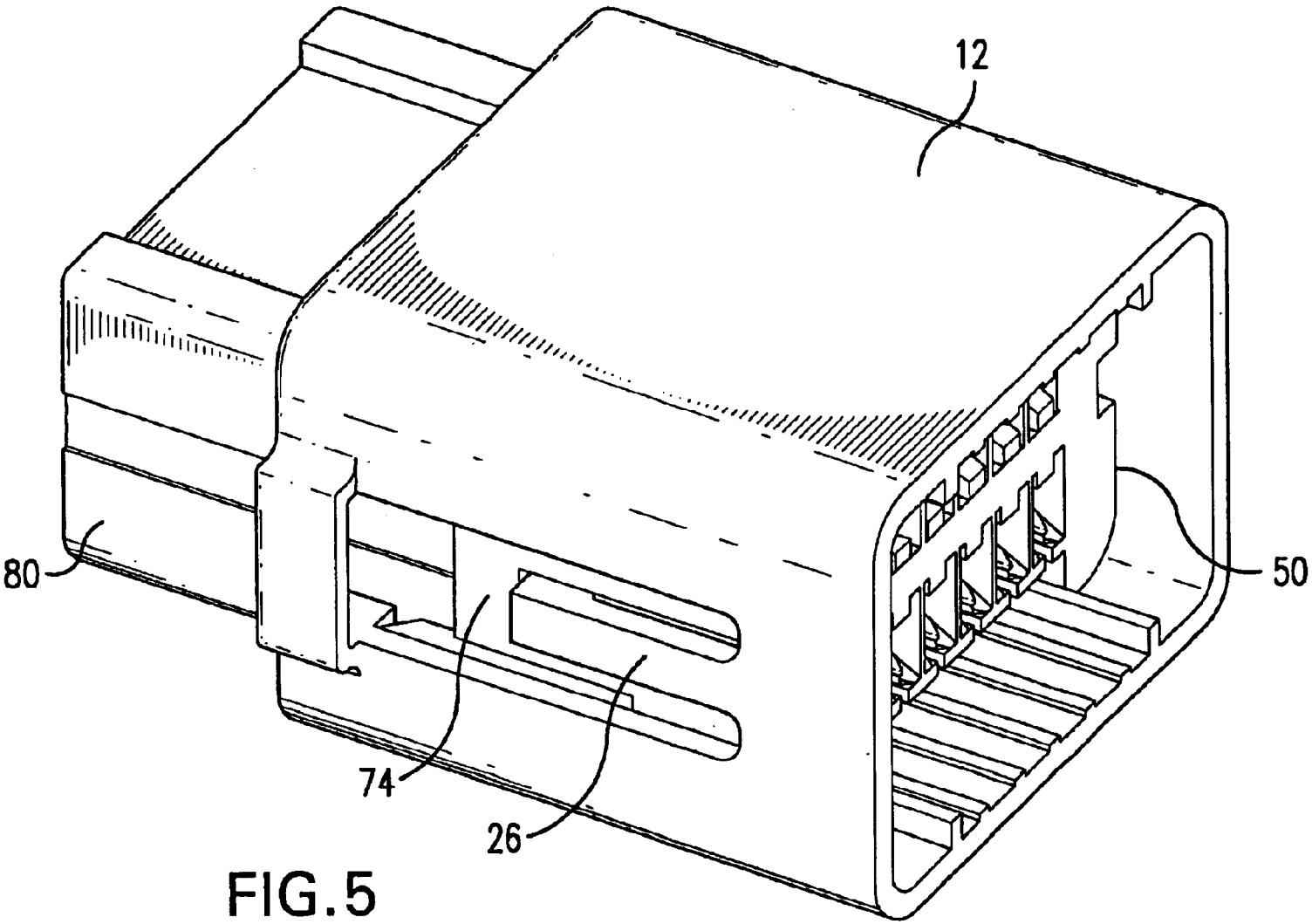
FIG. 5 is a perspective view of the male connector assembled into a first, short-active position with the holder and female connector.
Figure 6:
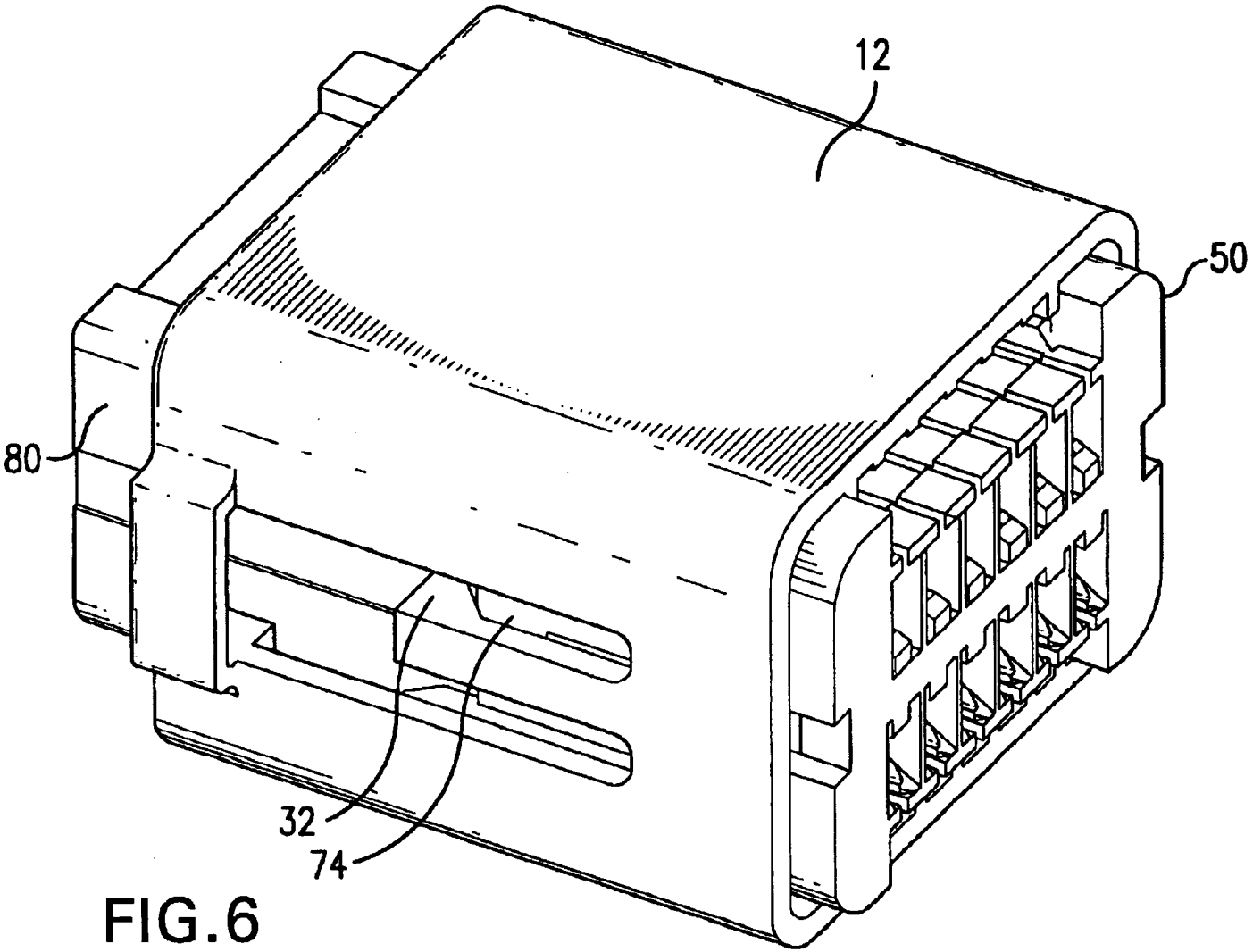
FIG. 6 is a perspective view of the male connector assembled into a second, short-disconnected position with the holder and female connector.

FIG. 5 shows the male connector 80 as it approaches full mating with the female connector 50 in the holder 12 but still in the first position. The short is still active because of the continued engagement of the short contacts 40 with the female terminals in the female connector through the slots 62. FIG. 6 illustrates the second, short-disconnect position of the mated connectors. The pawls 32 of the holder lock arms 26 have been released from the latching edges 72 of the cross-pieces 74 of the female connector side walls 52, allowing the mated connectors to move to the second position.

Figure 7:
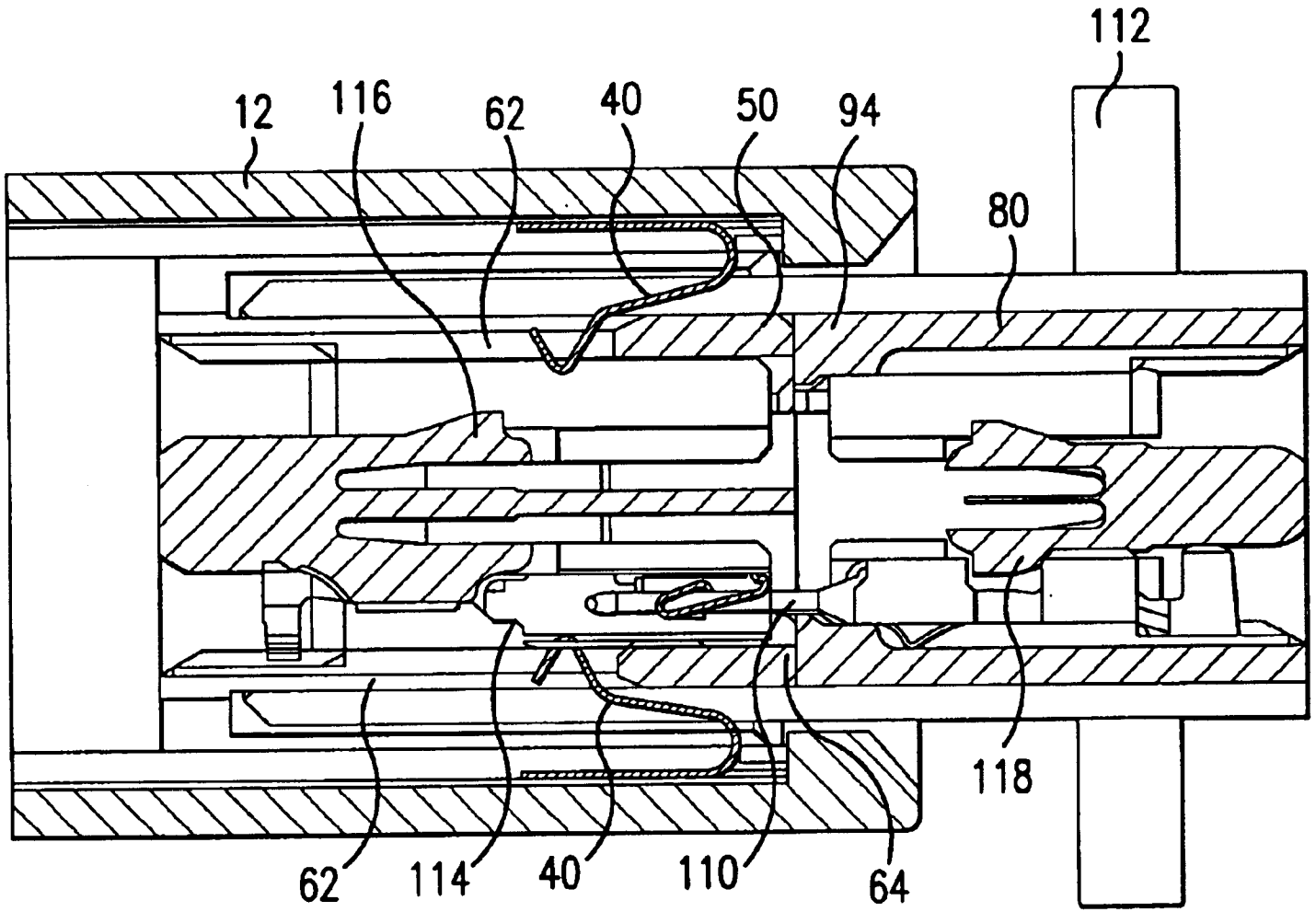
FIG. 7 is a cross-sectional side view of the male and female connectors in mating engagement within the holder with shorting bars in contact with female terminals.
Figure 8:
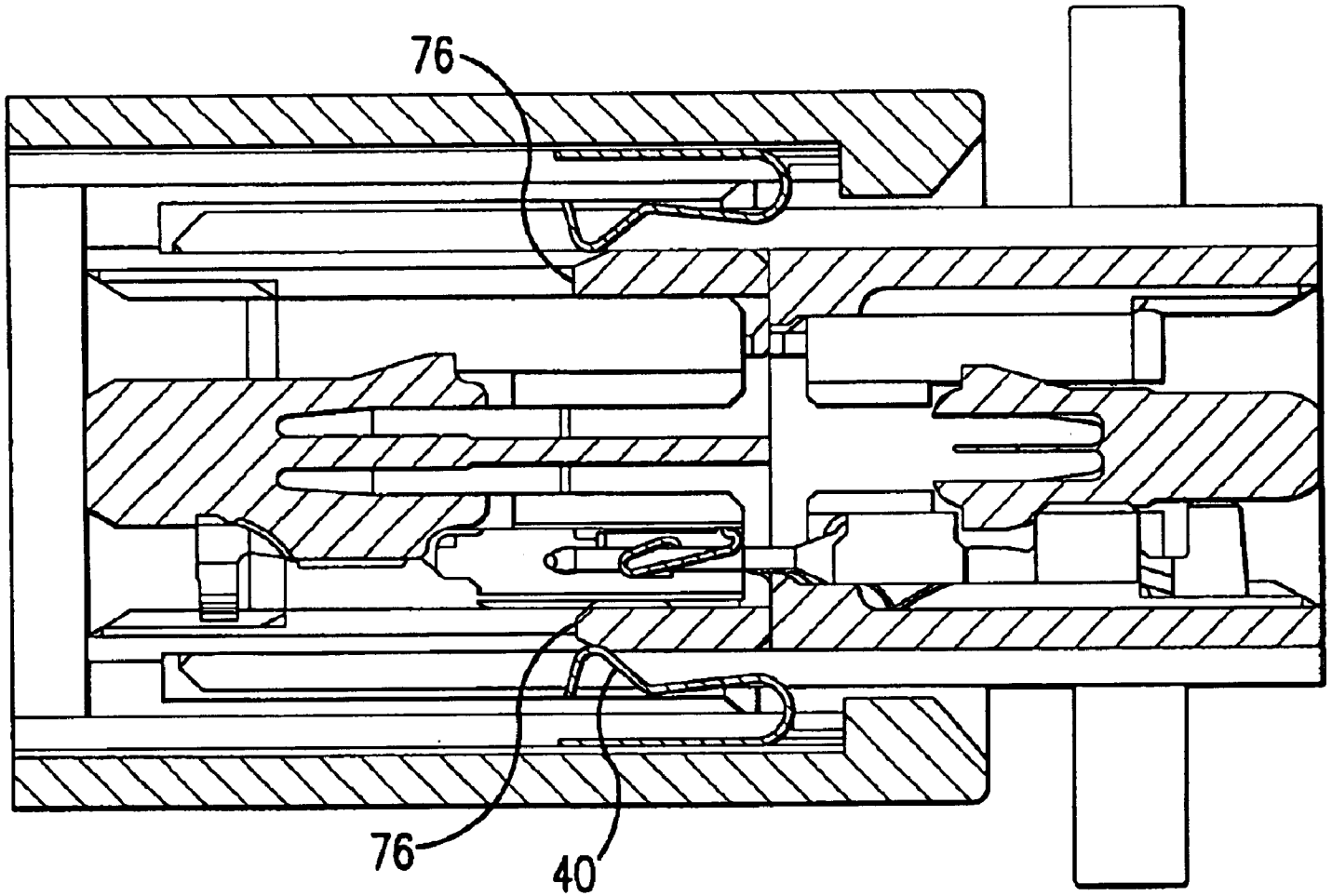
FIG. 8 is a cross-sectional side view of the mated male and female connectors with the shorting bars pushed out of electrical contact with the female terminals.

FIGS. 7 and 8 demonstrate the movement of the mated connectors from the first to second positions within the holder in more detail. A single conventional male electrical terminal 110 is shown in the male connector 80 and a single female conventional electrical terminal 114 is shown in the female connector 50 for demonstration purposes. The terminated electrical wires are not shown for simplicity. Conventional locks 116 and 118 secure the female and male terminals in their respective connectors. It should be understood that the invention concept can be used for connectors having any number and type of terminal accommodating chambers, terminals and shorting contacts or systems, including systems wherein the terminal or terminals are shorted to a vehicle ground.

FIG. 7 illustrates the first position, corresponding to FIG. 5, wherein the male and female connectors are fully mated and the male terminal 110 and female terminal 114 are in electrical engagement. The shorting contacts 40 are still in electrical engagement with the female terminals through the slots 62 of the female connector. The mating surface 94 of the male connector 80 is pressed against the end 64 of the female connector 50.

Further insertion force on the male connector moves the mated connectors to the second position, as shown in FIG. 8. The shorting contacts 40 are cammed out of the slots 62 by the beveled termination or cam surfaces 76 of the slots adjacent female connector end 64. The short is thereby disconnected. The shorting contacts cannot be disconnected until the connectors are fully mated. This ensures that the terminals are electrically engaged before the short is disconnected. Movement of the assembled connectors beyond the second, short-disconnected position can be arrested by the securement of the male connector bracket to a panel, for example. If the assembly is used in an in-line system, stops can be formed on the male connector to contact the holder 12. The point is to allow axial adjustment of the mated connectors as a unit, without relative movement between the connectors. The second position can be a range of positions in which the short is disconnected.

As the male connector is pulled out of the holder in a reverse movement, the female connector returns to the first position within the holder. The shorting contacts drop back down into the slots 62 to again engage the female terminals before the connectors are unmated because movement of the female connector with the male connector is not arrested until the female connector ends of the guide rails 68 again abut the stop blocks 36 of the holder. The operating surfaces 108 of the ramp projections 102 on the male connector press against the latch edges 72 on the female connector to keep the connectors together until movement of the female connector is halted by the stop blocks. Continued pulling force causes the ramp projections to lift the cross-piece 74 and enable release of the male connector as the pawls 32 of the holder lock arms 26 drop back down or in against the latch edges.

The male and female connectors move as a unit rather than moving against or relative to each other. Full mating of the connectors is ensured. The unit can still move slightly after the shorting contacts have been disconnected to account for tolerances. The shorting contacts are reliably in electrical engagement with the female terminals until after full electrical and mechanical contact between the male and female terminals and before the terminals are disconnected. The holder covers and protects the mated connectors. Since the connectors don't move relative to reach other, wear on the terminals is reduced and fretting corrosion is minimized. The shorting spring prongs are wiped during the mating/unmating operation by the beveled cam surfaces and upper wall of the female connector. This wiping action removes oxide buildup and ensures reliable electrical contact every time the shorting contacts engage the female terminals. Because the connection and disconnection process involves only axial forces on the connectors to move them into and out of the holder, the assembly can be easily automated.

Since minor changes and modifications varied to fit particular operating requirements and environments will be understood by those skilled in the art, this invention is not considered limited to the specific examples chosen for purposes of illustration. The invention is meant to include all changes and modifications which do not constitute a departure from the true spirit and scope of this invention as claimed in the following claims and as represented by reasonable equivalents to the claimed elements.

What is claimed is:

1. A connector assembly comprising:

a holder having at least one shorting contact;

a first connector for fitting within the holder in a first position, the first connector having a cam surface and at least one electrical terminal for electrical engagement with the at least one shorting contact; and a second connector for mating with the first connector in the first position, the second connector having at least one electrical terminal for electrical engagement with the at least one terminal of the first connector when the first and second connectors are engaged to provide mated connectors, the mated connectors being movable together to a second position within the holder, whereby the cam surface of the first connector pushes the at least one shorting contact out of contact with the at least one terminal of the first connector as the mated connectors move to the second position.

2. The connector assembly of claim 1 further comprising at least one lock arm on the holder and at least one latch edge on the first connector, the at least one lock arm engaging the at least one latch edge to secure the first connector in the first position in the holder.

3. The connector assembly of claim 2 further comprising at least one projection on the second connector located to release the at least one lock arm of the holder from the at least one latch edge of the first connector when the connectors are mated in the first position.

4. The connector assembly of claim 3 wherein the at least one projection on the second connector is also situated to engage the at least one latching edge of the first connector when the connectors are mated, whereby the connectors are secured together as a unit.

5. The connector assembly of claim 2 further comprising at least one stop on the holder located such that the first connector is held between the at least one stop and the lock arm in the first position.

6. The connector assembly of claim 1 wherein the at least one cam surface is beveled where it contacts the at least one shorting contact.

7. The connector assembly of claim 1 further comprising at least one slot through the first connector, the at least one shorting contact extending through the at least one slot to engage the at least one terminal in the first connector when the connectors are in the first position.

8. The connector assembly of claim 7 wherein the at least one cam surface is formed by an extremity of the at least one slot.

9. A connector assembly comprising:

a holder;

a first connector;

means on the holder and first connector for releasably securing the first connector in a first position in the holder;

shorting contacts on the holder for electrically engaging electrical terminals in the first connector when the first connector is in the first position;

means on the first connector for separating the shorting contacts and terminals when the first connector is released from the first position and moved to another position in the holder;

a second connector for mating with the first connector in the first position; and means on the second connector for releasing the first connector from the first position.

10. The connector assembly of claim 9 further comprising means on the second connector for locking the second connector to the first connector.

11. The connector assembly of claim 10 wherein the releasing means and locking means are opposite surfaces of at least one projection on the second connector.

12. An apparatus comprising:

a holder having a plurality of shorting contacts;

a first connector having a plurality of electrical terminals and a slot associated with each terminal, each slot having an end;

means on the holder and first connector for holding the first connector in an initial position within the holder with the shorting contacts extending through the slots into electrical engagement with the terminals;

a second connector having a plurality of electrical terminals for electrically mating with the terminals of the first connector; and means on the second connector for releasing the holding means after the terminals of the first and second connectors are mated, whereby the first connector can be moved from the initial position.

13. The apparatus of claim 12 wherein the ends of the slots are placed to nudge the shorting contacts out of the slots when the first connector is moved from the initial position.

14. The apparatus of claim 12 wherein the holding means is at least one lock arm on the holder and at least one corresponding latch edge on the first connector.

15. The apparatus of claim 14 wherein the releasing means is a projection on the second connector for separating the at least one lock arm from the at least one latch edge as the connectors are pressed together.

16. The apparatus of claim 15 wherein the projection has a first surface for separating the at least one lock arm from the at least one latch edge and a second surface for catching on the latch edge, whereby the second connector is locked to the first connector after the holding means is released and the connectors move as a unit to a position where the shorting contacts are disconnected from the terminals.

17. The apparatus of claim 16 wherein the second surface and latch edge are configured to be detachable when the connectors are moved back to the initial position and the shorting contacts reengage the terminals.

18. The apparatus of claim 12 wherein the first connector is a female connector with female electrical terminals and the second connector is a male connector with male electrical terminals.

* * * * *